US006984092B1

(12) United States Patent
Meyer et al.

(10) Patent No.: US 6,984,092 B1
(45) Date of Patent: Jan. 10, 2006

(54) CORNER CONNECTION FOR TEMPORARY SHORING

(76) Inventors: John Henry Meyer, 1509 Shore Dr., Edgewater, MD (US) 21037; John Wayne Meyer, 9323 4th St., Lanham, MD (US) 20706

( * ) Notice: Subject to any disclaimer, the term of this patent is extended or adjusted under 35 U.S.C. 154(b) by 0 days.

(21) Appl. No.: 10/879,589

(22) Filed: Jun. 30, 2004

(51) Int. Cl.
*E02D 17/04* (2006.01)

(52) U.S. Cl. ..... 405/283; 405/282; 405/272

(58) Field of Classification Search ..... 405/272, 405/282, 283; 403/335, 337; 256/65.01, 256/65.15, 68
See application file for complete search history.

(56) References Cited

U.S. PATENT DOCUMENTS

| | | | |
|---|---|---|---|
| 1,225,431 | A | 5/1917 | Gelbart |
| 2,690,326 | A | 9/1954 | Kranick |
| 2,888,818 | A | 6/1959 | Leuthesser |
| 2,956,409 | A | 10/1960 | Wicke |
| 3,159,978 | A | 12/1964 | De Lillo |
| 3,420,065 | A | 1/1969 | Holl |
| 3,496,727 | A | 2/1970 | De Wesse et al. |
| 3,584,465 | A | 6/1971 | Holl |
| 3,750,409 | A | 8/1973 | Orfei |
| 3,992,887 | A | 11/1976 | Fisher |
| 4,208,038 | A | 6/1980 | Reid |
| 4,398,840 | A | 8/1983 | French |
| 4,453,863 | A | 6/1984 | Sutton et al. |
| 4,682,914 | A | 7/1987 | Aihara et al. |
| 4,685,837 | A | 8/1987 | Cicanese |
| 4,850,747 | A | 7/1989 | Morelli |
| 4,993,880 | A | 2/1991 | Collins |
| 5,073,066 | A | 12/1991 | Richland |
| 5,154,541 | A | 10/1992 | Boren et al. |
| 5,214,899 | A | 6/1993 | Beeche et al. |
| 5,232,313 | A | 8/1993 | Jennings et al. |
| 5,234,188 | A | 8/1993 | McSwain |

(Continued)

FOREIGN PATENT DOCUMENTS

| | | |
|---|---|---|
| GB | 2166774 | 5/1986 |

*Primary Examiner*—Sunil Singh
(74) *Attorney, Agent, or Firm*—Diederiks & Whitelaw, PLC

(57) ABSTRACT

A corner connection used to secure I-beams together at corners within the excavation site is provided with a reinforcing assembly that allows for greater loads. Typically, four I-beams are connected together to form a rectangular frame that is suspended within the excavation for bracing the shoring walls thereof; however, any polygonal shape may be used. The corner connection itself comprises mating socket or connecting members that are placed over the ends of I-beams to be fastened together. One of the connecting members includes an outwardly extended tab while the other includes a pair of outwardly extended tabs. The first outwardly extending tab fits between the two extending tabs of the corresponding connecting member. All of the tabs are provided with apertures that are placed in alignment when the connection is made so that a bolt or pin can be passed through the apertures to secure the two connectors together. An additional set of tabs is provided on the connecting members that is also provide with apertures. A reinforcing assembly is provided and includes a reinforcing bar with tabs. A first spacer bar is attached to the reinforcing bar and one connecting member and a second spacer bar is attached to the reinforcing bar and an adjacent connecting member. The spacer bars, the reinforcing bar and the connection members are all connected with tab/pin connections. Advantageously the reinforcing assembly can use the existing second set of tabs located on the prior art connectors. Such an arrangement provides much greater support for the sidewalls of the excavation site.

19 Claims, 4 Drawing Sheets

U.S. PATENT DOCUMENTS 5,690,446 A 11/1997 Poissant et al.
5,711,131 A 1/1998 Thomas
5,741,091 A 4/1998 St. George et al.
5,966,890 A 10/1999 Inman
6,267,538 B1 7/2001 Caldwell
6,416,259 B1 * 7/2002 Meyer ..... 405/283

* cited by examiner

CORNER CONNECTION FOR TEMPORARY SHORING

BACKGROUND OF THE INVENTION

1. Field of the Invention

The present invention is generally directed to a system for temporarily shoring up an excavation site. More particularly the invention is directed to a reinforcing assembly for a corner connection used in a reinforcing arrangement that supports sheet piling in an excavation site.

2. Description of the Prior Art

In a typical excavation site, workers are exposed to numerous hazards. The most common hazard is having the walls of the excavation site cave in on the workers, thus causing serious injury. Often due to soil conditions and wetness, the sides of a construction site will simply collapse. Water is a particularly dangerous hazard because it is so heavy and can destroy shoring, which has not been properly reinforced. Realizing this problem the government, at both the federal and state level, has set up specific requirements for all excavation sites to avoid the problem of cave-ins. For example the United States Department of Labor and, more specifically, the Occupational Safety and Health Administration (OSHA) requires that excavation sites be prepared with some type of shoring. Additionally many companies are now aware of the problems involved in a typical excavation site and have developed internal policies requiring shoring for any excavations they contract to have completed.

A good example of a typical excavation project is found in replacing underground storage tanks for a gasoline station. Typically, in such an operation, sheet piling is pounded into the ground in a generally rectangular configuration around the work site. The piling has to be driven extremely deeply into the ground and arranged to provide sufficient support against potential cave-ins. Typically the sheet piling has to be driven so deep that half its total height remains underground after the excavation has been completed. Use of such large amounts of material is quite expensive. After the sheet piling has been installed, the workmen then remove the dirt and fill material from within the rectangular shoring. During the work of removing the old storage tanks and replacing them with new storage tanks the shoring provides protection to the workmen against potential cave-ins. Once the storage tank replacement operation has been completed the shoring can either be completely removed or simply cut down We to a safe distance below ground and then left in place. Such a method of shoring an excavation site is extremely expensive.

Various solutions have been proposed in an attempt to cut down on the costs of shoring an excavation site. For example U.S. Pat. No. 5,154,541 discloses a modular earth support system. Specifically, the patent teaches using panels placed around an excavation site and interlocked with one another to form a generally rectangular shoring configuration. Once the panels are in place, reinforcing beams are placed behind the panels to ensure the weight and force of the dirt behind the panels does not cause the panels to fail. The main drawback of using such a system is that standard I-beams cannot be used. Rather, special beams that are cut exactly to size and additionally have a customized end configuration must be used. Such beams are particularly expensive; especially considering a large number of beams of varying sizes would have to be kept available for differently sized excavation sites.

Another proposed solution to reducing the high cost of shoring excavation sites is found in U.S. Pat. No. 4,685,837.

This patent proposes using panels as shoring members in an excavation site and uses laterally extending braces to reinforce the panels. The braces are connected to one another by a bracket. Alternatively, the braces maybe connected to each other by means of a connection in which one brace has a pair of tabs welded thereto with each tab having an aperture formed therein. The apertures align with a hole in a second brace and a pin is placed though the apertures to complete the connection. In either case there is no provision to adjust the length of the braces and connectors and they must be custom made for each different sized excavation site.

Numerous other proposed solutions are available including using wooden shoring which is a custom made to a particular excavation site. Such shoring is used only at the designated site and then disposed of. As a result this approach is prohibitively expensive. Also wooden shoring is not as durable as its metal counterparts. Often water along with regular wear and tear at the construction site can destroy the shoring during the construction job.

Perhaps the best solution proposed so far is set forth in U.S. Pat. No. 6,416,259 which is incorporated herein by reference. In that patent a corner connection for temporary shoring is shown as being used in an excavation site. Specifically, the corner connection is used to secure I-beams together at corners within the excavation site. Typically, four I-beams are connected together to form a rectangular frame that is suspended within the excavation for bracing the shoring walls thereof. The corner connection itself comprises mating socket or connecting members that are placed over the ends of I-beams to be fastened together. Some portions of this prior patent are summarized below in the discussion of FIGS. 4 and 5 labeled "Prior Art".

Turning now to FIG. 4, there is illustrated a close-up view of a corner connection 11 located at the ends of two I-beams 20, 21, including two meeting connectors 29, 30. Each connector 29, 30 has a similar overall shape. However, one type of connector 29 has a single tab 32 while the other type of connector 30 has a double tab 34, 36. A single tab type connector 29 shown in FIG. 4 includes a box-like main body portion 40 having an opening 45 therein for receiving an I-beam 21. The box-like main body portion 40 comprises five major panels to form the open box shape. Opposing top 50 and bottom 51 panels are connected with opposing side panels 55, 56 to form the square or rectangular opening 45 designed to receive the I-beam 21. An end panel 57 also preferably square or rectangular in shape closes off one end of the box type main body 40. These five pieces 50, 51, 55, 56, 57 are all made of heavy steel and are welded together. The end panel 57 and one of the side panels 56 have the single tab 32 welded thereto. The tab 32 is a flat plate like member that extends laterally from the box-like main body portion 40 of the connector 29 and has an aperture 60 formed therein. The tab 32 is made of a similar material as the panels of the box-like main body 40. The tab 32 is preferably welded to the side 56 and end 57 panels.

A double tab type connector 30 shown in FIG. 4 includes a box-like main body portion 70 having an opening 75 therein for receiving an I-beam 20. The box-like main body portion 70 comprises five major panels to form the open box shape. Opposing top 80 and bottom 81 panels are connected with opposing side panels 85, 86 to form the square or rectangular opening 75 designed to receive the I-beam 20. An end panel 87 also preferably square or rectangular in shape closes off one end of the box type main body 70. These five pieces 80, 81, 85, 86, 87 are all made of heavy steel and are welded together. The end panel 87 and one of the side panels 86 have top and bottom tabs 34, 36 welded thereto.

The tabs 34, 36 are flat members which extend laterally from the box-like main body portion 70 of the connector 30 and each have an aperture 90, 91 formed therein. The tabs 34, 36 are made of a similar material as the panels of the box-like main body 70. The tabs 34, 36 are preferably welded to the side 86 and end 87 panels. While other methods may be used to attach the tabs 34, 36 it is important that the tabs 34, 36 be able to withstand the tremendous hydraulic pressures which may be transmitted by sheet piling 219 (seen in FIG. 1) as it starts to buckle.

As can clearly be seen in FIG. 4, connectors 29, 30 may easily be joined together by placing the tab 32 of the single tab connector 29 within the two tabs 34, 36 of the double tab connector 30. Ideally, the single tab aperture 60 aligns with the apertures 90, 91 formed in each of the two tabs 34, 36 of the double tab connector 30. A securing bolt or pin 100 is placed through the aligned apertures 60, 90, 91 in order to pivotably secure the connectors 29, 30 together.

Turning now to FIG. 5, there is shown a second preferred embodiment of the invention. Specifically, the box like connectors 29, 30 of the first embodiment illustrated in FIG. 4 now are shown with modifications to support an added reinforcing member. Since the connectors 29', 30' shown in FIG. 5 are based on the connectors 29, 30 shown in FIG. 4 only a discussion of the modifications will be provided here.

Essentially each box type connector 29', 30' has a box-like main body 40', 70' that has been lengthened along with its corresponding panels 50', 51', 55', 56', 80', 81', 85', 86' to provide room to support a pair of extra tabs 101, 102, 103, 104 each tab has an aperture (only two shown) 106, 108 formed therein. A reinforcing bar 120 having a tab 130, 131 located at each end is provided to reinforce the two box type connectors 29', 30'. The tabs 130, 131 located at the end of reinforcing bar 120 each have an aperture (not shown) located therein which will cooperate and align with the apertures 106, 108, formed in the extra tabs 101, 102, 103, 104 of each box type connector 29', 30'. A pin 100 may then be placed in the respective apertures once they are in proper alignment to hold the reinforcing bar 120 in place.

However even with this reinforcing bar 120 in place the maximum permissible load may be insufficient and the expense of using heavier materials is always a factor.

Based on the above, therefore there exists a need in the prior art of excavation shoring to provide a system wherein shoring can be provided at an excavation site in an inexpensive and reusable manner that does not suffer the disadvantages of the prior art discussed above. More specifically there exists in the art a need to provide a connector for interconnecting various beams used to reinforce shoring in a manner which may allow much greater loading than previously has been available but still uses the same parts as used in previous shoring systems.

SUMMARY OF THE INVENTION

Specifically, a corner connection used to secure I-beams together at corners within the excavation site is provided with a reinforcing assembly that allows for greater loads. Typically, four I-beams are connected together to form a rectangular frame that is suspended within the excavation for bracing the shoring walls thereof however; any polygonal shape may be used. The corner connection itself comprises mating socket or connecting members that are placed over the ends of I-beams to be fastened together.

One of the connecting members includes an outwardly extended tab while the other includes a pair of outwardly extended tabs. The first outwardly extending tab fits between the two extending tabs of the corresponding connecting member. All of the tabs are provided with apertures that are placed in alignment when the connection is made so that a bolt or pin can be passed through the apertures to secure the two connectors together. An additional set of tabs is provided on the connecting members that is also provided with apertures. A reinforcing assembly is provided and includes a reinforcing bar with tabs. A first spacer bar is attached to the reinforcing bar and one connecting member and a second spacer bar is attached to the reinforcing bar and an adjacent connecting member. The spacer bars, the reinforcing bar and the connection members are all connected with tab/pin connections. Advantageously the reinforcing assembly can use the existing second set of tabs located on the prior art connectors.

The socket members also include a large eyelet for receiving a chain or other elongated supporting member that is typically used to suspend the resulting I-beam frame at a desired height within the shoring walls.

Additional objects, features and advantages of the present invention will more readily be apparent from the following description of the preferred embodiment thereof, when taken in connection with the drawings wherein like reference numerals refer to correspond parts in the several views.

DETAILED DESCRIPTION OF THE PREFERRED EMBODIMENTS

Figure 1:
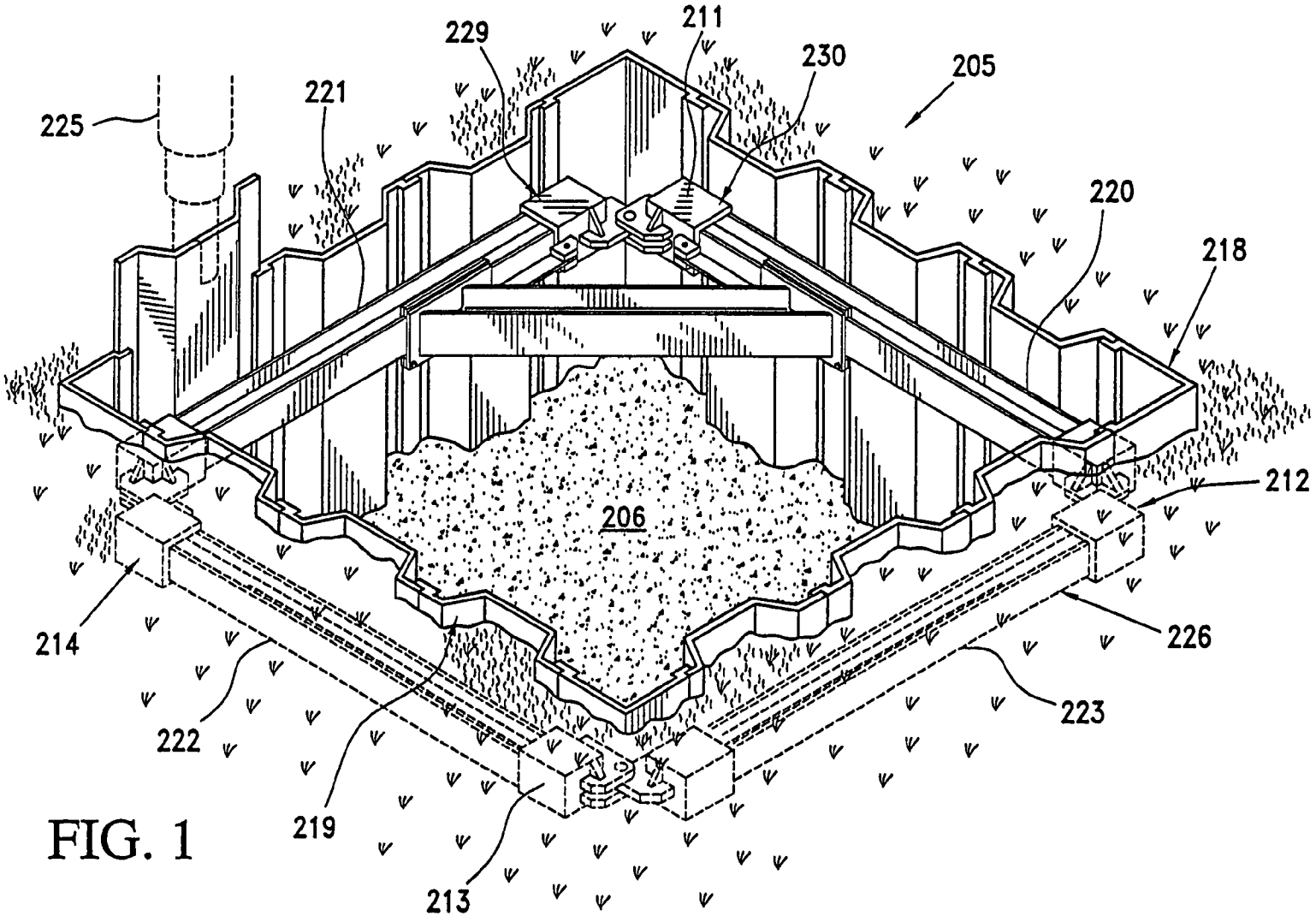
FIG. 1 is a prospective view of a corner connection, a reinforcing assembly and associated shoring beams for temporary shoring according to a first preferred embodiment of the invention as it would be seen in use in a typical excavation site.

Referring now to FIG. 1 there is shown a typical excavation site 205 with an excavation hole 206 incorporating corner connections 211–214 for temporary shoring 218 according to a preferred embodiment of the invention. The temporary shoring 218 actually comprises three major elements: interlocking sheet piling 219, reinforcing I-beams or shoring beams 220–223 and corner connections 211–214, each connection including two connectors for the I-beams 220–223. Although shown here as I-beams, beams of different shapes could be used so long as the connector and beam have mating shapes. For example, round, L-shaped and U-shaped beams could be used, as could a beam of almost any cross section. Interlocking sheet piling 219 is shown placed along the walls of the excavation hole 206. Such interlocking sheet piling 219, which in the embodiment shown is formed by interconnecting two types of side wall panels and corner panels (not separately labeled), is usually driven into the ground prior to any digging. Typically a driving machine 225, which is essentially a pile driver, is used to drive each section of piling 219 to a desired depth within the ground. As mentioned above, typically such sheet piling 219 was driven two to three times the depth of the excavated hole 206. In this preferred embodiment however, because of the I-beams 220–223 and the corner connections 211–214, the sheet piling 219 need only be driven slightly deeper than the desired depth of the excavation hole 206. In either case the sheet piling 219 is driven into the ground one panel at a time each panel becoming an upstanding wall portion.

The panels of piling 219 have interlocking edges and thus can provide support for each other once they are in place. Also the panels 219 are formed in an undulating pattern for added strength. Typically such panels 219 are made of relatively thick and expensive sheet metal. It is important to note that using large quantities of such a sheet metal is extremely expensive. Furthermore, using prior shoring methods, the sheet metal was often left at the excavation site 205 at the conclusion of the construction job. As will be discussed more fully below, with the subject method, the amount of sheet piling 219 used is not only reduced, but less sheet piling 219 is required initially because the sheet piling 219 only has to extend as deep as the excavation hole 206.

A reinforcing structure 226 is provided behind the interlocking sheet piling 219. The reinforcing structure 226 includes the set of I-beams 220–223 that interact with the set of corner connections 211–214. Such a structure 226 is needed in order to prevent the sheet piling 219 from buckling under the weight of the earth surrounding the sheet piling 219. This is particularly true when the earth is wet or particularly loose. The corner connections 211–214 are designed to receive the ends of the I-beams 220–223 to form a rectangular structure. While a rectangular shape is shown here and is probably the most common configuration used it should be kept in mind that any polygonal configuration of three or more sides could be used and not depart from the spirit of the invention.

Under normal conditions the reinforcing structure 226 would simply be suspended by a chain or other mechanism (not shown) at a desired height within the excavation hole 206. If however, the sheet piling 219 starts to buckle under the weight of wet earth it will immediately engage with the reinforcing structure 226. As pressure is placed on the I-beams 220–223 and corner connections 211–214 they will only give a small distance before applying an enormous normal force that will stop the sheet piling 219 from any further buckling.

Figure 2:
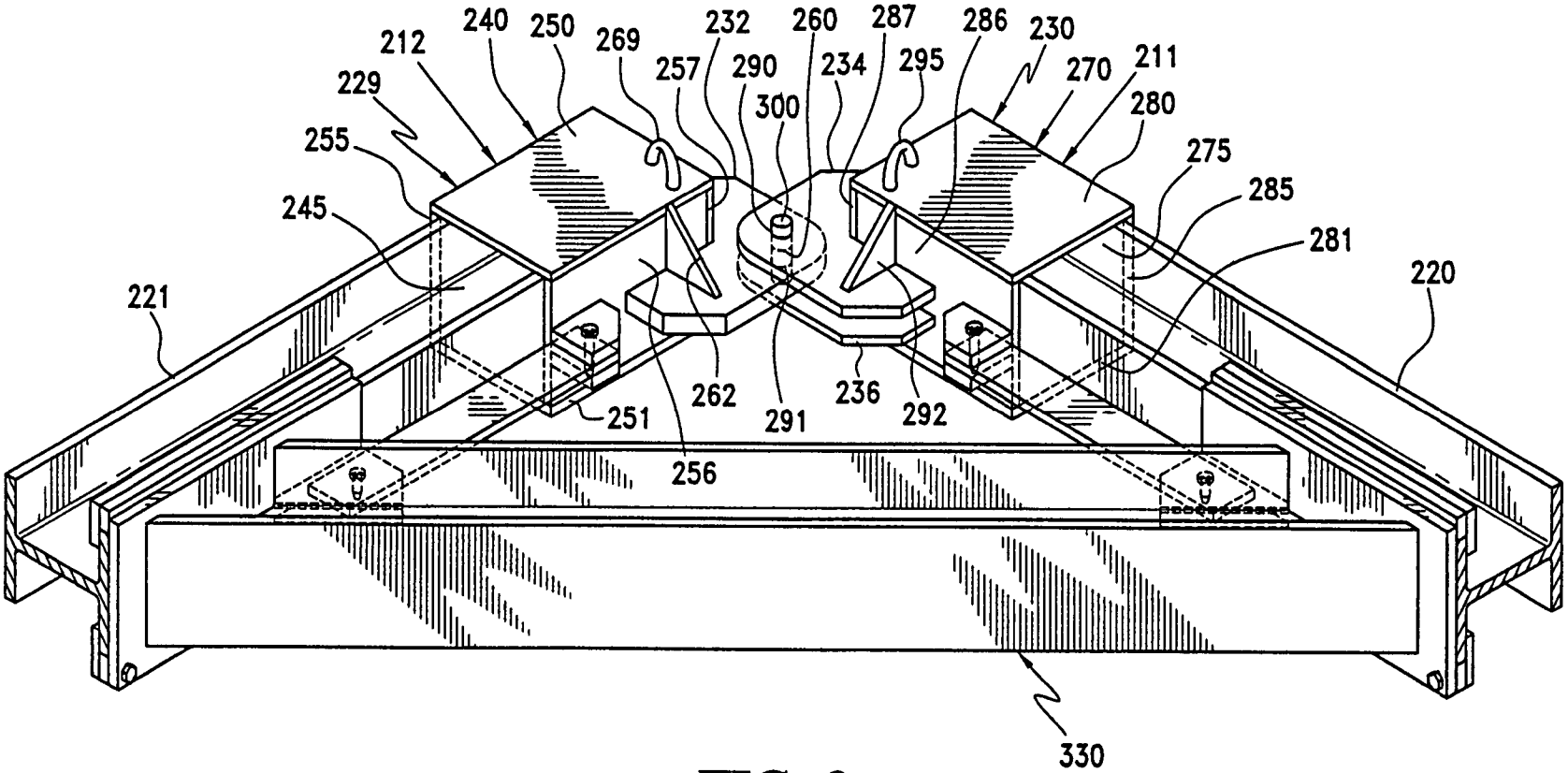
FIG. 2 is a close-up perspective view of a corner connection including two corner connectors and a reinforcing assembly shown in their engaged condition connecting two shoring beams according to the first preferred embodiment of the invention.

Turning now to FIG. 2, there is illustrated a close-up view of a corner connection 211 including two meeting connectors 229, 230 and the ends of two I-beams 220, 221. Each connector 229, 230 has a similar overall shape. However, one type of connector 229 has a single tab 232 while the other type of connector 230 has a double tab 234, 236. A single tab type connector 229 shown in FIG. 2 includes a box-like main body portion 240 having an opening 245 therein for receiving an I-beam 221. The box-like main body portion 240 comprises five major panels to form the open box shape. Opposing top 250 and bottom 251 panels are connected with opposing side panels 255, 256 to form the square or rectangular opening 245 designed to receive the I-beam 221. An end panel 257 also preferably square or rectangular in shape closes off one end of the box type main body 240. These five pieces 250, 251, 255, 256, 257 are all made of heavy steel and are welded together. The end panel 257 and one of the side panels 256 have the single tab 232 welded thereto. The tab 232 is a flat plate-like member that extends laterally from the box-like main body portion 240 of the connector 229 and has an aperture 260 formed therein. The tab 232 is made of a similar material as the panels of the box-like main body 240. The tab 232 is preferably welded to the side 256 and end 257 panels. While other methods may be used to attach the tab 232, it is important that the tab 232 be able to withstand the tremendous hydraulic pressures that may be transmitted by the sheet piling 219 as it starts to buckle.

Optionally a gusset 262 is formed between the side panel 256 and the tab 232 for added strength. An additional gusset (not shown) may be formed between the tab 232 and the end panel 257. Preferably an eyelet 269 is formed on the top panel 250. The eyelet 269 is designed to receive a chain or other elongated supporting member (not shown) used to support the I-beams 220–223 and corner connections 211–214 at a desired height within the excavation hole 206. The eyelet 269 is completely optional as the chain could simply be placed around one of the I-beams 220–223 to provide support.

A double tab type connector 230 shown in FIG. 2 includes a box-like main body portion 270 having an opening 275 therein for receiving an I-beam 220. The box-like main body portion 270 comprises five major panels to form the open box shape. Opposing top 280 and bottom 281 panels are connected with opposing side panels 285, 286 to form the square or rectangular opening 275 designed to receive the I-beam 220. An end panel 287 also preferably square or rectangular in shape closes off one end of the box type main body 270. These five pieces 280, 281, 285, 286, 287 are all made of heavy steel and are welded together. The end panel 287 and one of the side panels 286 have top and bottom tabs 234, 236 welded thereto. The tabs 234, 236 are flat members that extend laterally from the box-like main body portion 270 of the connector 230 and each have an aperture 290, 291 formed therein. The tabs 234, 236 are made of a similar material as the panels of the box-like main body 270. The tabs 234, 236 are preferably welded to the side 286 and end 287 panels. While other methods may be used to attach the tabs 234, 236 it is important that the tabs 234, 236 be able to withstand the tremendous hydraulic pressures which may be transmitted by the sheet piling 219 as it starts to buckle.

Optionally a gusset 292 is formed between the side panel 286 and the top tab 234 for added strength. Webs (not shown) may be formed between the two tabs 234, 236 in order to further increase their strength. An additional gusset (not shown) may be formed between the top tab 234 and the end panel 287. Preferably an eyelet 295 is formed on the top panel 280. The eyelet 295 is designed to receive a chain or other elongated supporting member (not shown) used to support the I-beams 220–223 and corner connections 211–214 at a desired height with the excavation site 205. The eyelet 295 is completely optional as the chain could simply be placed around the I-beams 220–223 to provide support.

As can clearly be seen in FIG. 2, connectors 229, 230 may easily be joined together by placing the tab 232 of the single tab connector 229 within the two tabs 234, 236 of the double tab connector 230. Ideally, the single tab aperture 260 aligns with the apertures 290, 291 formed in each of the two tabs 234, 236 of the double tab connector 230. A securing bolt or pin 300 is placed through the aligned apertures 260, 290, 291 in order to pivotably secure the connectors 229, 230 together. The bolt or pin 300 previously supported all the forces transmitted between the two connected I-beams 220, 221 and was subject to failure. However as discussed more fully below, the temporary shoring 218 has been modified with an improved reinforcing assembly 330.

Figure 3:
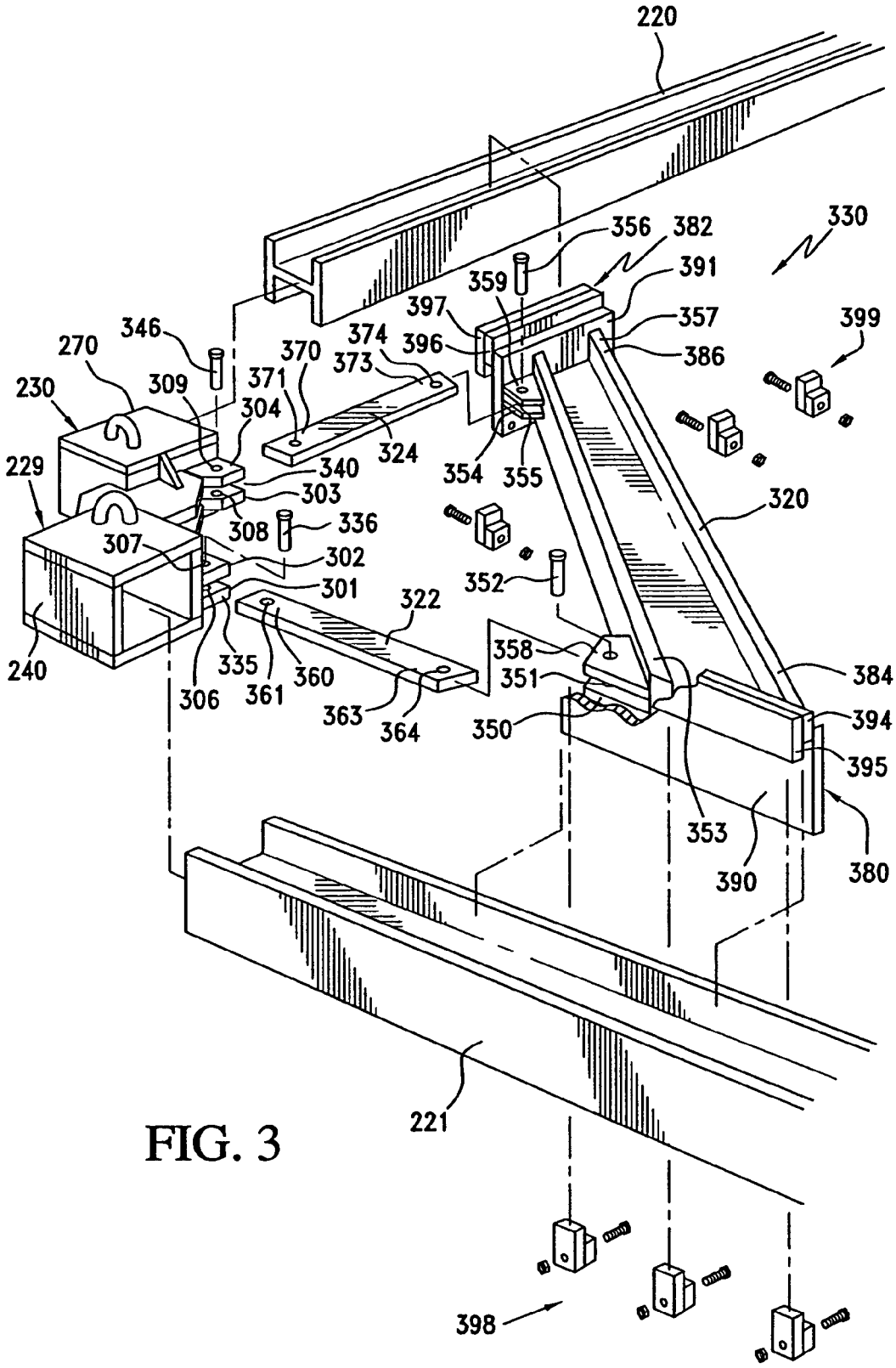
FIG. 3 is an exploded view of the assembly shown in FIG. 2.
Figure 4:
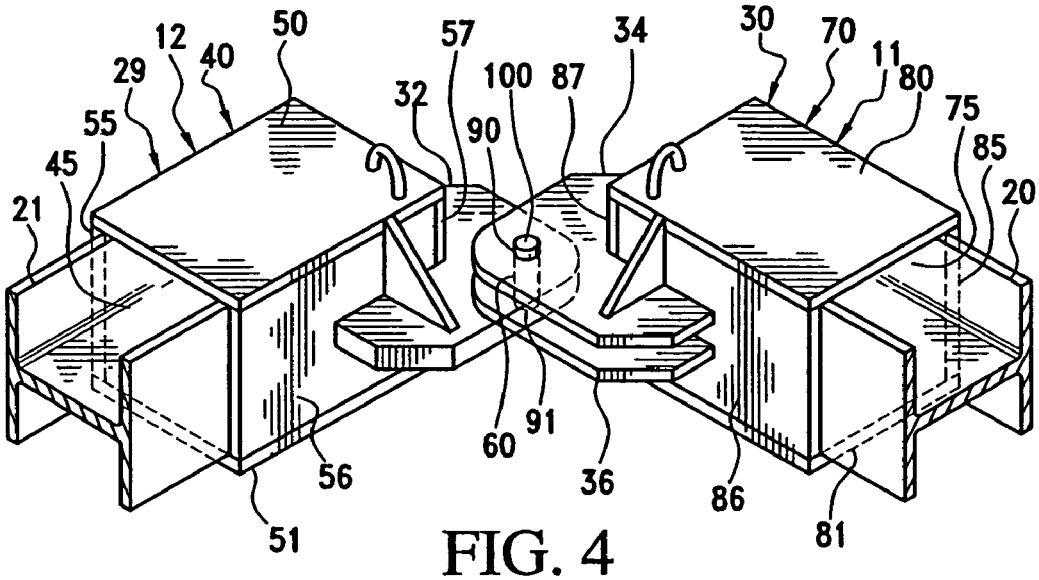
FIG. 4 PRIOR ART
FIG. 4 is a prospective view of a corner connection including two corner connectors shown in their engaged condition according to the prior art.
Figure 5:
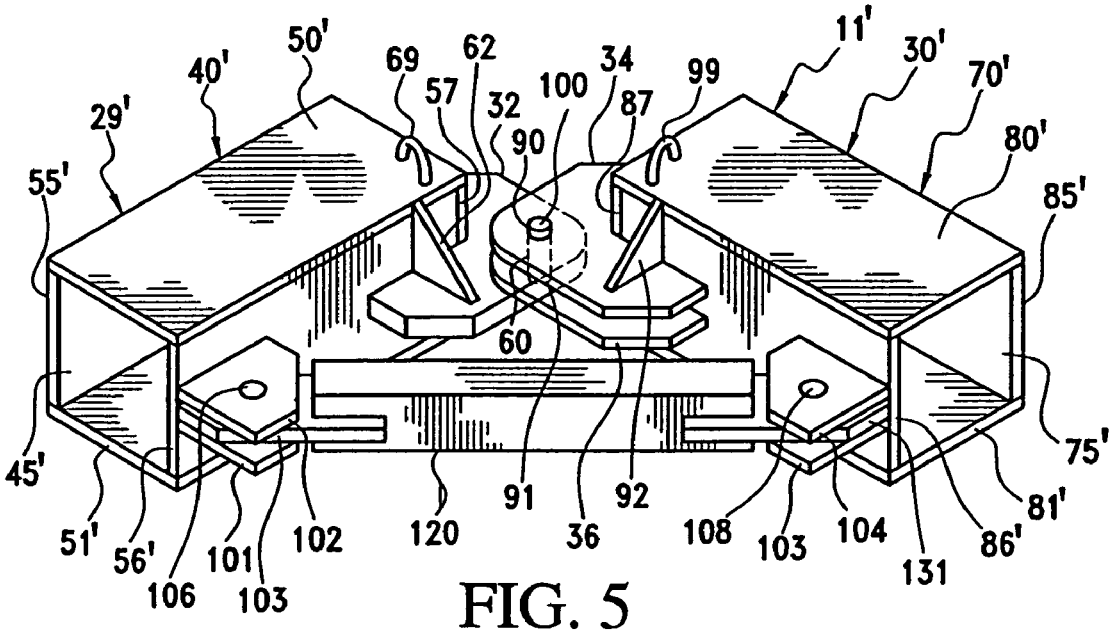
FIG. 5 PRIOR ART
FIG. 5 is a plan view of a corner connection including two corner connectors and a reinforcing bar shown in their engaged condition according the prior art.

As can best be seen in FIG. 3 each box type connector 229, 230 also supports a pair of extra tabs 301, 302, 303, 304 and each tab has an aperture 306, 307, 308, 309 formed therein. While the box connectors 229, 230 are shown with pairs of extra tabs 301, 302, 303, 304 only a single extra tab 302, 304 on each connector 229, 230 is required. The box type connectors 229, 230 described so far are known in the art and are substantially identical to the box type connectors 29' 30' described above with reference to FIG. 5.

The reinforcing assembly 330 includes a reinforcing bar 320, a first spacer bar 322 attached to the reinforcing bar 320 and the first shoring beam connector 229 and a second spacer bar 324 attached to the reinforcing bar 320 and the second shoring beam connector 230. The reinforcing bar 320 is formed of a standard I-beam that has had its ends cut at 45 degrees so as to form the overall temporary shoring 218 into a square configuration. As mentioned above other shapes and angles could be used. The reinforcing bar 320 will preferably be 8 feet or 12 feet long but other sizes may be used as desired. The spacer bars 322, 324 are simply rectangular flat pieces of steel. The spacer bars must be sized based on the length of the reinforcing bar 320 and the angle of the corner connection. As such this length is set by the geometry of the temporary shoring 218.

A first fastening assembly 335 includes the first tab 301 that extends laterally from the main body portion 240 of the first shoring connector 229. The first tab 301 has an aperture 306 located therein adapted to receive a first connecting pin 336. Optionally the first fastening assembly may also include the second tab 302 having aperture 307 aligned with aperture 306 and adapted to receive the first connecting pin 336. A second fastening assembly 340 includes the first tab 303 extending laterally from said main body portion 270 of the second shoring beam connector 230, and has aperture 309 located therein adapted to receive a second connecting pin 346. Optionally the second fastening assembly 340 may also include a second tab 304 having an aperture 309 aligned with the aperture 308 and adapted to receive second connecting the pin 346.

The reinforcing bar 320 further comprises a first tab 350 with an aperture 351 adapted to receive a third connecting pin 352 located at a first end 353 and a second tab 354 with an aperture 355 adapted to receive a fourth pin 356 located at a second end 357. Optionally third and fourth tabs 358, 359 may be added to the reinforcing bar 320 and be aligned with first and second tabs 350, 354 respectively.

The first spacer bar 322 further comprises an end 360 with an aperture 361 located therein adapted to receive the first connecting pin 336, a second end 363 with an aperture 364 located therein is adapted to receive the third pin 352. When the optional tabs 302, 358 of the first corner connector 229 and the reinforcing bar 320 are used, the ends 360, 363 of the spacer bar 332 will fit between the tabs 301, 302 of the first corner connector 229 and the tabs 350, 358 of the reinforcing bar 320.

The second spacer bar 324 further comprises a first end 370 with an aperture 371 located therein adapted to receive the second connecting pin 346. A second end 373 with an aperture 374 located therein is adapted to receive the fourth pin 356. When the optional tabs 304, 359 of the second corner connector 230 and the reinforcing bar 320 are used the respective ends 370, 373 of the spacer bar 324 will fit between the tabs 303, 304 of the second corner connector 230 and the tabs 354, 359 of the reinforcing bar 320.

The reinforcing bar 320 has a hook 380, 382 attached to each end 384, 386 and each said hook 380, 382 is adapted to be connected to a respective shoring beam 221, 220. The hooks 380, 382 are formed of a main plate 390, 391 welded to each end 384, 386 of the reinforcing bar 320 and an additional two smaller plates 394, 395, 396, 397 are welded to the main plates 390, 391 to form a hook configuration. The hooks 380, 382 mate with the top web of the respective I-beam shaped shoring beams 221, 220. Additional lower hooks 398, 399 may be mounted to the main plates 390, 391 but they are completely optional because the weight of the reinforcing bar 320 is sufficient to keep it in place.

In operation, typically the entire temporary shoring assembly 218 arrives on a truck. Initially the I-beams 220–223 are arranged in a rectangular or other polygonal shape around the perspective excavation site. Next the connectors 229, 230 such as shown in FIG. 2 are placed on the ends of the I-beams 220–223 forming corner connections 211–214. It is important to note that the connectors 229, 230 may simply be slipped onto the ends of the I-beams 220–223 and that they do not need to be welded thereto. Essentially the main body portion 240 of the connector 229 is adapted to slidably receive the end of an I-beam 221 until it hits an abutment such as the end wall 257. Of course, any abutment will do so long as it transfers force from the I-beam 221 to the connector 229. As such, the connections 211–214 and I-beams 220–223 may be easily assembled on excavation site 205. Next the apertures 260, 290, 291 in the tabs 232, 234, 236 of each single and double tab connector 229, 230 are aligned and a pin 300 is placed therethrough. After the connections 211–214 and beams 220–223 are in place, the reinforcing assembly 330 may be added.

First the reinforcing bar 320 is placed on the shoring beams 221, 220 so that the hooks 380, 382 seat on the top web (not separately labeled) of each shoring beam 221, 220. Next the spacer bars 322, 324 are placed so that the apertures 361, 364, 371, 374 on the first and second ends 360, 363; 370, 373 of each bar 322, 324 align with the appropriate apertures 306–309, 351, 355, of the corner connectors 229, 230 and reinforcing bar 320. At this point the optional lower hooks 398, 399 may be installed. The reinforcing assembly structure 226 formed of the I-beams 220–223 and corner connections 211–214 now defines the edge of the excavation site 205. The sheet piling 219 is driven into the ground around the reinforcing structure 226.

Previously, the sheet piling 219 would have to be driven 2 ft. into the ground for every 1 ft. deep into the ground the excavation site 205 would extend. The cost of using so much sheet piling 219 is extremely expensive. With this new invention the sheet piling 219 need only extend slightly below the bottom of the excavation site 205.

Once the sheet piling 219 is in place, the dirt and other material within the excavation site's perimeter is then removed. The reinforcing structure 226 is then lowered to an appropriate height. The reinforcing structure 226 is held at that height by chains that extend to the eyelet on each box connector. It should be noted that the reinforcing structure 226 would not actually be under load until and if the sheet piling 219 starts to buckle under the load of dirt or water located behind a sheet piling 219. If the sheet piling 219 starts to buckle the corner connections 211–214 will take that load and be forced tighter unto their respective I-beams 220–223. Once any tolerance between the I-beams 220–223 and corner connections 211–214 is taken up the reinforcing structure 226 will then prevent any further movement of the sheet piling 219 and also prevent a cave in. When pressure is applied to the main I-beams 220–223 from the walls of the excavation hole 205 as they try to collapse the spacer bars 322, 324 keep the reinforcing bar 320 in place and stop it from moving away from the corner connection 211. The reinforcing bar 320 then takes most of the load, much more of a load than could be handled by the corner connection 211 on its own. Workers can then move about the excavation site 205 and safely perform whatever task is necessary. For example, the workers could remove old storage tanks (not shown) that may need removing and replace them with a new set of storage tanks (not shown). Additionally, other structures may be formed within the excavation site 205. For example of a slab of concrete may be poured at the bottom of the excavation site 205 to aid in supporting storage tanks. Additionally, gravel or other fill material may be placed around the tanks as is needed. All the while, the workers will be safe from any potential cave in.

Once the excavation site 205 is ready to be refilled, typically a corner sheet of piling 219 is removed so as to enable the workers to remove the corner connections 211–214. Once one set of corner connectors is removed, the rest of the reinforcing structure 226 can easily be removed from the excavation site 205 and used again. One of the great benefits of the instant invention is that a much greater load can be supported by the overall temporary shoring 218. Additionally, with the use of the reinforcing assembly 330 even larger holes may be shored. Indeed holes with sides of up to 60 feet per side may be shored which much greater than can be shored without the reinforcement assembly 330.

Although described with respect to preferred embodiments of the invention, it should be understood that various changes and/or modifications could be made to the invention without departing from the spirit thereof. Therefore, the specific embodiments disclosed herein are to be considered illustrative and not restrictive. Instead, the invention is only intended to be limited by the scope of the following claims.

What is claimed is:

1. A corner connection for connecting shoring beams of a temporary shoring arrangement, said corner connection comprising:

a first shoring beam connector including a hollow main portion formed along a first longitudinal axis and an opening situated at one longitudinal end of said main body portion, wherein said main body portion is adapted to slidably receive, through said opening, a respective end of one of said shoring beams, and a first fastening assembly;

a second shoring beam connector including a hollow main body portion formed along a second longitudinal axis and an opening situated at one longitudinal end of said main body portion of the second shoring beam connector, wherein the main hollow body portion of the second shoring beam connector is adapted to slidably receive, through said opening of the second shoring beam connector, a respective end of a respective one of said shoring beams, and a second fastening assembly; and a reinforcing assembly including a reinforcing bar, a first spacer bar extending along a respective shoring beam and substantially beyond the hollow main portion of the first shoring beam connector and attached to the reinforcing bar and the first shoring beam connector and a second spacer bar attached to the reinforcing bar and the second shoring beam connector.

2. A corner connection according to claim 1 wherein said first fastening assembly includes a first tab extending laterally from said main body portion of said first shoring beam connector and having an aperture located therein adapted to receive a first connecting pin.

3. A corner connection according to claim 2 wherein said second fastening assembly includes a first tab extending laterally from said main body portion of the second shoring beam connector, and having an aperture located therein adapted to receive a second connecting pin.

4. A corner connection according to claim 3 wherein the reinforcing bar further comprises a tab with an aperture adapted to receive a third connecting pin located at a first end and a tab with an aperture adapted to receive a fourth pin located at a second end.

5. A corner connection according to claim 4 wherein the first spacer bar further comprises a first end with an aperture located therein adapted to receive the first connecting pin and a second end with an aperture located therein adapted to receive the third pin.

6. A corner connection according to claim 5 wherein the second spacer bar further comprises a first end with an aperture located therein adapted to receive the second connecting pin and a second end with an aperture located therein adapted to receive the fourth pin.

7. A corner connection according to claim 1 wherein said reinforcing bar has a hook attached to each end each said hook adapted to be connected to a respective shoring beam.

8. In a temporary shoring arrangement including upstanding wall portions positioned within an excavation site and braced by a plurality of shoring beams, a corner connection comprising:

a first shoring beam connector including a hollow main portion formed along a first longitudinal axis and an opening situated at one longitudinal end of said main body portion, wherein said main body portion is adapted to slidably receive, through said opening, a respective end of one of said shoring beams, and a first fastening assembly;

a second shoring beam connector including a hollow main body portion formed along a second longitudinal axis and an opening situated at one longitudinal end of said main body portion of the second shoring beam connector, wherein the main hollow body portion of the second shoring beam connector is adapted to slidably receive, through said opening of the second shoring beam connector, a respective end of a respective one of said shoring beams, and a second fastening assembly; and a reinforcing assembly including a reinforcing bar, a first spacer bar extending along a respective shoring beam and substantially beyond the hollow main portion of the first shoring beam connector and attached to the reinforcing bar and the first shoring beam connector and a second spacer bar adapted to extend along a respective shoring beam and attached to the reinforcing bar and the second shoring beam connector.

9. A corner connection according to claim 8 wherein said first fastening assembly includes a first tab extending laterally from said main body portion of said first shoring beam connector and having an aperture located therein adapted to receive a first connecting pin.

10. A corner connection according to claim 9 wherein said second fastening assembly includes a first tab extending laterally from said main body portion of the second shoring beam connector, and having an aperture located therein adapted to receive a second connecting pin.

11. A corner connection according to claim 10 wherein the reinforcing bar further comprises a tab with an aperture adapted to receive a third connecting pin located at a first end and a tab with an aperture adapted to receive a fourth pin located at a second end.

12. A corner connection according to claim 11 wherein the first spacer bar farther comprises a first end with an aperture located therein adapted to receive the first connecting pin and a second end with an aperture located therein adapted to receive the third pin.

13. A corner connection according to claim 12 wherein the second spacer bar further comprises a first end with an aperture located therein adapted to receive the second connecting pin and a second end with an aperture located therein adapted to receive the fourth pin.

14. A corner connection according to claim 13 wherein said reinforcing bar has a hook attached to each end each said hook adapted to be connected to a respective shoring beam.

15. A method of providing temporary shoring in an excavation site having upstanding wall portions comprising the steps of:

a) assembling a plurality of shoring beams with a series of corner connectors by slidably positioning an end portion of a respective shoring beam within a hollow main body portion of a corresponding corner connector;

b) interconnecting adjacent corner connectors to arrange the plurality of shoring beams in a polygonal pattern with the plurality of shoring beams and corner connectors being positioned against the upstanding wall portions so as to brace the upstanding wall portions so as to define an overall temporary shoring support assembly; and c) attaching a reinforcing assembly having a reinforcing beam and two spacer bars to adjacent corner connectors to increase the maximum permissible load that the shoring support assembly may take before failure, each spacer bar extending along a respective shoring beam and substantially beyond a respective hollow main portion of the adjacent corner connector.

16. The method according to claim 15, wherein adjacent corner connectors are interconnected by inserting a pin through aligned apertures in mating tabs.

17. The method according to claim 15, wherein the reinforcing bar is connected to the spacer bars by inserting pins through aligned apertures formed in mating tabs.

18. The method according to claim 15, wherein the spacer bars are connected to respective corner connectors through aligned apertures in mating tabs.

19. The method of claim 17, wherein the spacer bars are connected to respective corner connectors through aligned apertures in mating tabs.

* * * * *